US010325737B2

(12) United States Patent
Woo et al.

(10) Patent No.: US 10,325,737 B2
(45) Date of Patent: Jun. 18, 2019

(54) FAST SWITCH DEVICE

(71) Applicant: HYOSUNG HEAVY INDUSTRIES CORPORATION, Seoul (KR)

(72) Inventors: Dong Kyun Woo, Seoul (KR); Jae Hyeong Ko, Gwangmyeong-si (KR)

(73) Assignee: HYOSUNG HEAVY INDUSTRIES CORPORATION, Seoul (KR)

( * ) Notice: Subject to any disclaimer, the term of this patent is extended or adjusted under 35 U.S.C. 154(b) by 0 days.

(21) Appl. No.: 15/538,202

(22) PCT Filed: Dec. 30, 2015

(86) PCT No.: PCT/KR2015/014474
§ 371 (c)(1),
(2) Date: Jun. 21, 2017

(87) PCT Pub. No.: WO2016/108613
PCT Pub. Date: Jul. 7, 2016

(65) Prior Publication Data

US 2017/0358411 A1 Dec. 14, 2017

(30) Foreign Application Priority Data

Dec. 30, 2014 (KR) ..... 10-2014-0193568

(51) Int. Cl.
*H01H 33/28* (2006.01)
*H01H 33/666* (2006.01)

(52) U.S. Cl.
CPC ..... *H01H 33/28* (2013.01); *H01H 33/285* (2013.01); *H01H 33/666* (2013.01)

(58) Field of Classification Search
CPC .... H01H 33/28; H01H 33/285; H01H 33/882; H01H 33/42; H01H 33/666; H01H 71/04;
(Continued)

(56) References Cited

U.S. PATENT DOCUMENTS 6,204,629 B1 3/2001 Rote et al.
6,518,865 B1 * 2/2003 Al-Hosini ..... H01H 33/285 335/147
(Continued)

FOREIGN PATENT DOCUMENTS

KR 101013709 B1 2/2011
KR 1020120130596 A 12/2012
(Continued)

OTHER PUBLICATIONS

Translation KR1020120130596 A (origal document published Dec. 3, 2012).*
(Continued)

*Primary Examiner* — Edwin A. Leon
*Assistant Examiner* — William A Bolton
(74) *Attorney, Agent, or Firm* — Novick, Kim & Lee, PLLC; Jae Youn Kim

(57) ABSTRACT

Disclosed is a fast switch device including: a reactor that moves to an open position where the switch is opened and a close position where the switch is closed; an open coil portion that drives the reactor to the open position by virtue of an eddy current component; a close coil portion that drives the reactor the close position by virtue of an eddy current component; and a controller that performs control such that an electric current is applied to the close coil portion oppositely to a direction of an electric current flowing through the open coil portion in order to brake the reactor during an open operation for driving the reactor to the open position, and an electric current is applied to the open coil portion oppositely to a direction of an electric current flowing through the close coil portion.

4 Claims, 3 Drawing Sheets

(58) Field of Classification Search
CPC ..... H01H 71/2481; H01H 79/00; H01H 1/50; H01H 71/42; H01H 71/24
USPC ..... 218/10, 135, 14, 24, 28, 68; 335/147; 200/48 R, 68, 337, 245
See application file for complete search history.

(56) References Cited

U.S. PATENT DOCUMENTS

| | | | | |
|---|---|---|---|---|
| 7,739,058 | B2 * | 6/2010 | Maruyama | H01F 7/1844 702/34 |
| 8,258,419 | B2 * | 9/2012 | Jeong | H01H 79/00 218/68 |
| 2004/0245857 | A1 | 12/2004 | Liljestrand et al. | |
| 2005/0002152 | A1 * | 1/2005 | Gemme | H01H 9/106 361/626 |
| 2014/0266520 | A1 * | 9/2014 | Jeong | H01H 3/222 335/38 |

FOREIGN PATENT DOCUMENTS

| | | | | |
|---|---|---|---|---|
| KR | 1020140108048 | A | 9/2014 | |
| WO | WO2014000790 | A1 * | 1/2014 | H01H 3/60 |

OTHER PUBLICATIONS

International Search Report in International Application No. PCT/KR2015/014474, dated Mar. 31, 2016.

* cited by examiner

[Fig. 3]
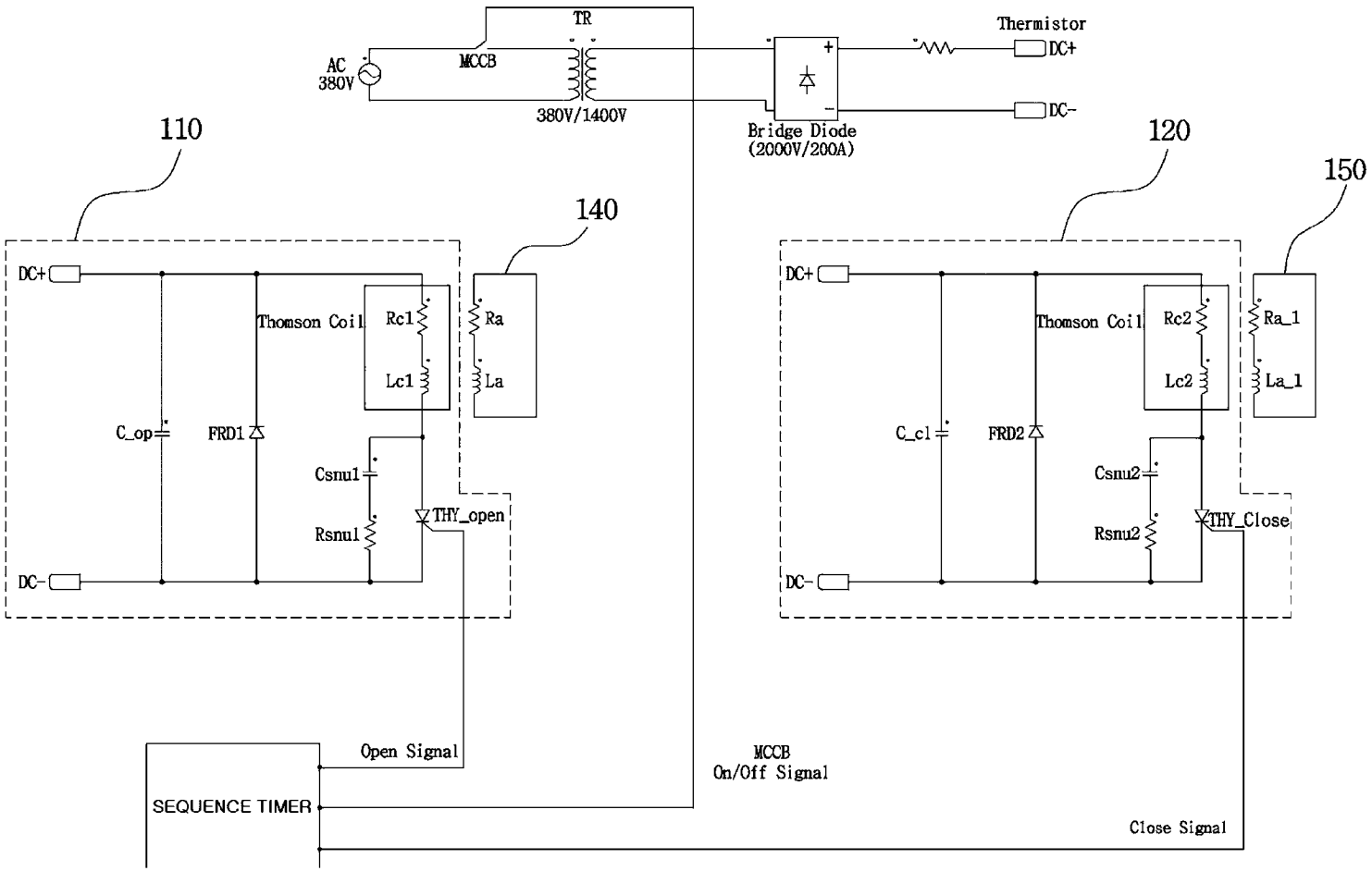

FAST SWITCH DEVICE

CROSS-REFERENCE TO RELATED APPLICATIONS

This application is the National Stage filing under 35 U.S.C. 371 of International Application No. PCT/KR2015/014474, filed on Dec. 30, 2015, which claims the benefits of Korean Patent Application No. 10-2014-0193568, filed on Dec. 30, 2014, the contents of which are all hereby incorporated by reference herein in their entirety.

TECHNICAL FIELD

The present invention relates to a fast switch device, and more particularly, to a vacuum circuit breaker and its operational mode, employed in a fast switch of a DC circuit breaker using a Thomson coil actuator.

BACKGROUND ART

A voltage-sourced conversion technology recently highlighted in high voltage direct-current (HVDC) transmission systems has a lot of advantages in the design of multi-terminal networks, compared to the conventional current source converters employed in the prior art.

As the voltage-sourced conversion technology advances, establishment of the HVDC multi-terminal network was facilitated, and a smart grid plan for a distributed renewable energy network was expedited. For this purpose, it is necessary to address technical problems in a DC circuit breaker for protecting transmission lines in advance.

Unlike the conventional DC circuit breakers, the voltage-sourced conversion technology requires low-loss and fast switching characteristics. Therefore, a hybrid circuit breaker was developed, in which mechanical conversion for satisfying a low-loss requirement and power-semiconductor-based electrical conversion for satisfying a fast switching requirement are combined.

As well known in the art, the fast switch is an electric power device adapted to switch between open and close positions in a high speed to cut off an abnormal current such as a short-circuit current or close a circuit rapidly.

Such a fast switch is operated in a very high speed, for example, within several milliseconds or several tens of milliseconds. As a result, it is possible to minimize an electric arc accident that may be generated during a circuit open/close operation and reduce damage to power devices such as a distributor panel by rapidly cutting off an abnormal current.

FIG. 1 is a cross-sectional view illustrating a fast switch of the prior art.

Referring to FIG. 1, a high-speed closing switch 100 has a first electrode 10 inside a casing 200 that forms external appearance and a second electrode 20 that faces the first electrode 10 over the first electrode 10. The first electrode 10 has an internal through-hole 14, and the second electrode 20 has a receiving recess 24 facing the through-hole 14.

The high-speed closing switch 100 further has a movable contact member 30 vertically movably housed inside the through-hole 14 of the first electrode 10. As the movable contact member 30 moves upward and is received by the receiving recess 24 of the second electrode 20, the outer circumferential surface of the movable contact member 30 adjoins with the inner circumferential surface of the through-hole 14, and the outer circumferential surface of the movable contact member 30 adjoins with the inner circumferential surface of the receiving recess 24. As a result, the first and second electrodes are electrically connected to each other.

In the prior art, a damping force is applied to a damping hole in order to absorb an impact on the contact when the operation is completed. However, in the prior art, since wear or damage is generated due to a mechanical motion, it is inevitable to perform maintenance disadvantageously.

DISCLOSURE OF INVENTION

Technical Problem

In view of the aforementioned problems, this disclosure has been made to provide a fast switch device capable of implementing electrical braking by obtaining a braking force from an eddy current component of the reactor and an external voltage stored in a capacitor.

Solution to Problem

The object of the present invention is not limited to those described above, and a person skilled in the art would apparently appreciate other objects by reading the following description.

According to an aspect of this disclosure, there is provided a fast switch device including: a reactor that moves to an open position where the switch is opened and a close position where the switch is closed; an open coil portion that drives the reactor to the open position by virtue of an eddy current component; a close coil portion that drives the reactor the close position by virtue of an eddy current component; and a controller that performs control such that an electric current is applied to the close coil portion oppositely to a direction of an electric current flowing through the open coil portion in order to brake the reactor during an open operation for driving the reactor to the open position, and an electric current is applied to the open coil portion oppositely to a direction of an electric current flowing through the close coil portion in order to brake the reactor during a close operation for driving the reactor to the close position.

In the fast switch device described above, the open coil portion may have a first Thomson coil and a first capacitor connected to the first Thomson coil in parallel, and the open coil portion may cause an electric current to flow to the first Thomson coil by using a voltage stored in the first capacitor to drive the reactor toward the open position by virtue of an eddy current component induced by the electric current flowing through the first Thomson coil.

In the fast switch device described above, the close coil portion may have a second Thomson coil and a second capacitor connected to the second Thomson coil in parallel, and the close coil portion may cause an electric current to flow to the second Thomson coil by using a voltage stored in the second capacitor to drive the reactor toward the close position by virtue of an eddy current component induced by the electric current flowing through the second Thomson coil.

The fast switch device described above may further include a first armature plate that is connected to the reactor and generates a driving force by virtue of an eddy current as a magnetic flux is generated in the first Thomson coil.

The fast switch device described above may further include a second armature plate that is connected to the reactor and generates a driving force by virtue of an eddy current as a magnetic flux is generated in the second Thomson coil.

In the fast switch device described above, the controller may determine a timing of applying the electric current for braking the reactor based on a position of the reactor and a current rise time of the electric current flowing through the open coil portion or the close coil portion.

In the fast switch device described above, the controller may perform control such that the electric current for braking the reactor is cut off as the open operation or the close operation is completed.

Advantageous Effects of Invention

According to this disclosure, by decelerating the reactor on an electrical basis, it is possible to reduce an impact received by the contact due to a rapid movement speed of the contact when the operation is completed.

In addition, according to this disclosure, it is possible to satisfy a speed requirement in an effective interval where the breaking performance of the circuit breaker is determined, and reduce the speed only when the operation is completed.

Furthermore, according to this disclosure, the braking is implemented in a non-contact manner. Therefore, it is possible to eliminate necessity of maintenance that was required in a mechanical brake device.

BRIEF DESCRIPTION OF DRAWINGS

FIG. 3 is a circuit diagram illustrating a fast switch device according to an embodiment of this disclosure.

MODE FOR THE INVENTION

Figure 1:
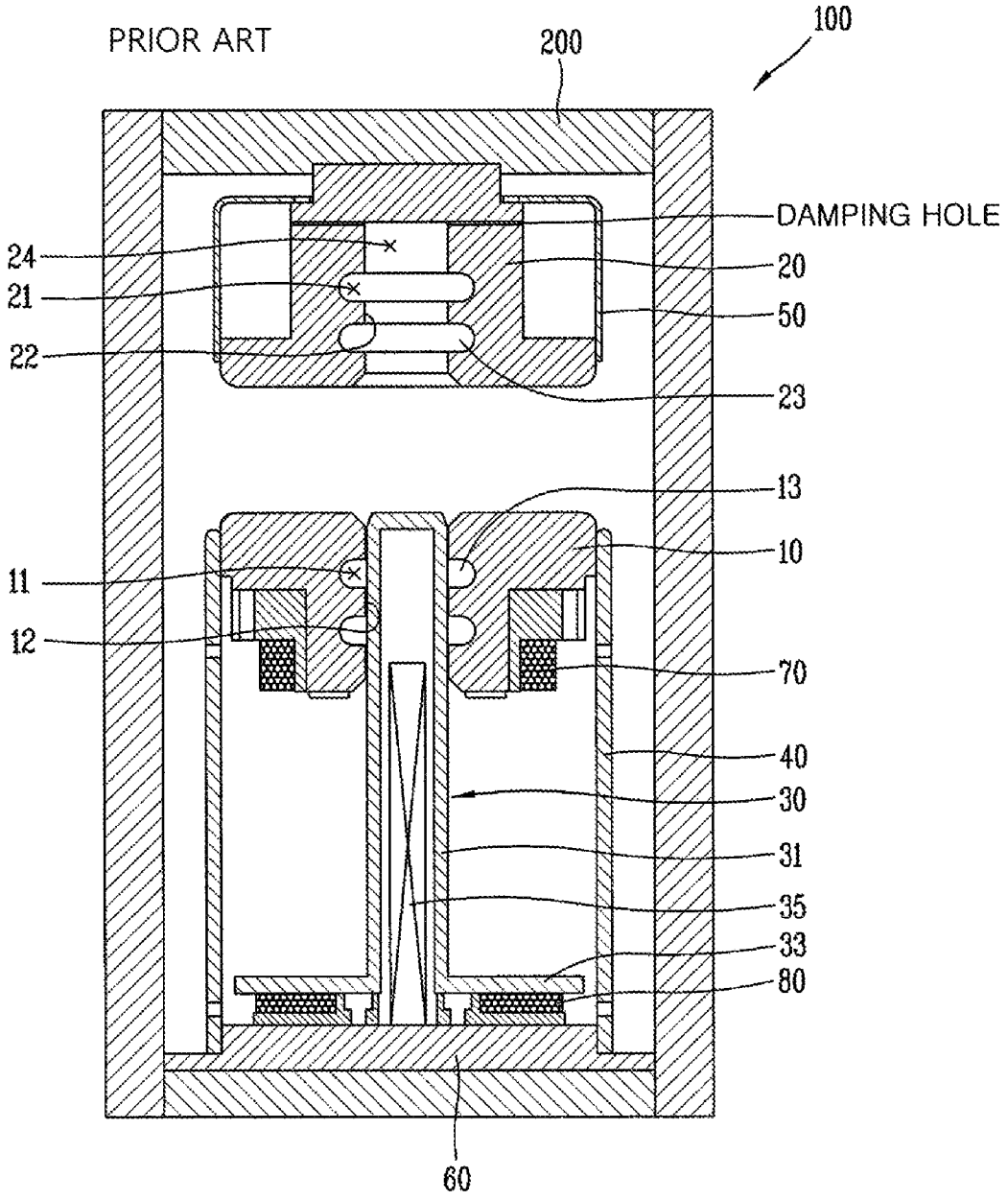
FIG. 1 is a cross-sectional view illustrating a fast switch of the prior art.

Since the present invention may be modified or embodied in various forms, particular embodiments will be described in detail with reference to the accompanying drawings. However, it should be noted that they are not intended to limit the invention, but include all possible all possible modifications, equivalents, and substitutes within the scope and spirit of the present invention.

The terminologies used herein are only for the purpose of describing particular embodiments and are not intended to limit the invention. As used herein, the singular forms "a", "an" and "the" may be intended to include the plural forms as well, unless the context clearly indicates otherwise. It is further to be noted that, as used herein, the terms "comprises", "comprising", "include", and "including" indicate the presence of stated features, integers, steps, operations, units, and/or components, but do not preclude the presence or addition of one or more other features, integers, steps, operations, units, and/or components, and/or combination thereof.

Unless specified otherwise, all terminologies used herein, including technical and scientific terminologies, have the same meaning as those understood generally by a person skilled in art. Terminologies defined in a general dictionary are to be construed as the same meanings as those understood in the context of the related art. Unless specified clearly herein, they are not construed as ideal or excessively formal meanings.

It is noted that like reference numerals denote like elements throughout overall drawings. In addition, descriptions of well-known apparatus and methods may be omitted so as to not obscure the description of the representative embodiments, and such methods and apparatus are clearly within the scope and spirit of the present disclosure.

Figure 2:
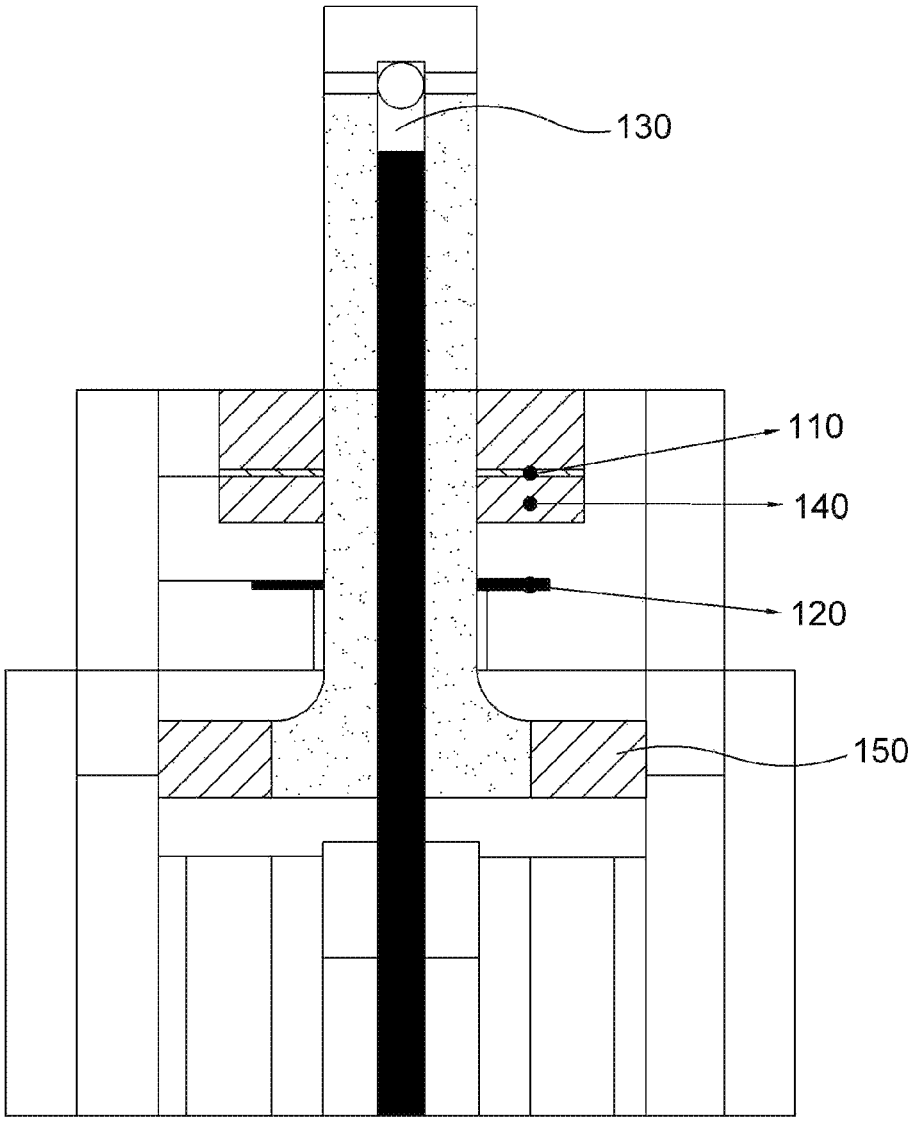
FIG. 2 is a cross-sectional view illustrating a fast switch device according to an embodiment of this disclosure.

FIG. 2 is a cross-sectional view illustrating a fast switch device according to an embodiment of this disclosure. FIG. 3 is a circuit diagram illustrating a fast switch device according to an embodiment of this disclosure.

Referring to FIGS. 2 and 3, a fast switch device according to this disclosure has a reactor 130, an open coil portion 110, a close coil portion 120, a first armature plate 140, a second armature plate 150, and a controller.

The open coil portion 110 is a coil circuit element for driving the reactor 130 toward an open position by using an eddy current.

The close coil portion 120 is a coil circuit element for driving the reactor 130 toward a close position by using an eddy current.

The controller performs control such that the reactor 130 is braked by applying an electric current to the close coil portion 120 oppositely to the current flowing to the open coil portion 110 during an open operation for driving the reactor 130 toward the open position. In addition, the controller performs control such that the reactor 130 is braked by applying an electric current oppositely to the current flowing to the close coil portion 120 to the open coil portion 110 during a close operation for driving the reactor 130 toward the close position.

The open coil portion 110 has a first Thomson coil and a first capacitor C_op connected to the first Thomson coil in parallel.

The open coil portion 110 causes an electric current to flow to the first Thomson coil by virtue of the voltage stored in the first capacitor C_op to drive the reactor 130 toward the open position by using an eddy current component induced by the current flowing through the first Thomson coil.

The close coil portion 120 has a second Thomson coil and a second capacitor C_cl connected to the second Thomson coil in parallel. The close coil portion 120 according to an embodiment of this disclosure does not affect performance of the circuit breaker. Therefore, it is preferable that the close coil portion 120 be designed to reduce the number of turns and the resistance of the coil in order to instantaneously apply a strong braking force to the reactor 130 by increasing a current rise rate.

The close coil portion 120 causes an electric current to flow to the second Thomson coil by virtue of the voltage stored in the second capacitor C_cl to drive the reactor 130 toward the close position by using eddy current component induced by the current flowing through the second Thomson coil.

The first armature plate 140 is connected to the reactor 130. As a magnetic flux is generated in the first Thomson coil, a driving force is generated by the eddy current.

The second armature plate 150 is connected to the reactor 130. As a magnetic flux is generated in the second Thomson coil, a driving force is generated by the eddy current.

According to this disclosure, the controller determines a timing for applying the electric current for braking the reactor 130 based on a position of the reactor 130 and a current rise time of the current flowing through the open coil portion 110 or the close coil portion 120.

As the open operation or the close operation is completed, the controller performs control such that the electric current for braking the reactor 130 is cut off, and the reactor 130 is not bound.

As described above, according to this disclosure, an electric current is applied to the close coil portion 120 oppositely to the direction of the current flowing through the open coil portion 110 to decelerate the reactor 130 while the current flows through the open coil portion 110 in order to place the reactor 130 in the open position. As a result, it is possible to reduce an impact received by the contact when the open operation is completed.

In comparison, according to this disclosure, an electric current is applied to the open coil portion 110 oppositely to the direction of the current flowing through the close coil portion 120 to decelerate the reactor 130 while the current flows through the close coil portion 120 in order to place the reactor 130 in the close position. As a result, it is possible to reduce an impact received by the contact when the close operation is completed.

As described above, according to this disclosure, the open coil portion 110 and the close coil portion 120 serve as both a driver for driving the reactor 130 and a brake for braking the reactor 130.

According to this disclosure, since driving and braking of the reactor 130 is controlled electrically, it is not necessary to perform maintenance that may be necessary in a mechanical brake system due to wear or damage.

Although exemplary embodiments of the present invention have been shown and described hereinbefore, it will be apparent to those having ordinary skill in the art that a number of changes, modifications, or alterations to the invention as described herein may be made, none of which depart from the spirit of the present invention. All such changes, modifications and alterations should therefore be seen as within the scope of the present invention.

REFERENCE SIGNS AND NUMERALS

110 open coil portion
120 close coil portion
130 reactor
140 first armature plate
150 second armature plate

INDUSTRIAL APPLICABILITY

The present invention relates to a fast switch device, and is applicable in the field of switch device.

The invention claimed is:

1. A switch device, comprising:

a reactor configured to move to an open position where the switch is opened and to a close position where the switch is closed;

an open coil portion configured to drive the reactor to the open position by virtue of an eddy current; and a close coil portion configured to drive the reactor to the close position by virtue of an eddy current, wherein the switch is configured to apply an electric current to the close coil portion oppositely to a direction of an electric current flowing through the open coil portion in order to brake the reactor during an open operation for driving the reactor to the open position, and further configured to apply an electric current to the open coil portion oppositely to a direction of an electric current flowing through the close coil portion in order to brake the reactor during a close operation for driving the reactor to the close position, wherein the switch is configured to determine a timing of applying the electric current for braking the reactor based on a position of the reactor and a current rise time of the electric current flowing through the open coil portion or the close coil portion, wherein the open coil portion has a first Thomson coil and a first capacitor connected to the first Thomson coil in parallel, and the open coil portion causes an electric current to flow to the first Thomson coil by using a voltage stored in the first capacitor to drive the reactor toward the open position by virtue of an eddy current induced by the electric current flowing through the first Thomson coil, wherein the close coil portion has a second Thomson coil and a second capacitor connected to the second Thomson coil in parallel, and the close coil portion causes an electric current to flow to the second Thomson coil by using a voltage stored in the second capacitor to drive the reactor toward the close position by virtue of an eddy current induced by the electric current flowing through the second Thomson coil, and wherein the second Thomson coil has fewer turns and lesser resistance than those of the first Thomson coil.

2. The switch device according to claim 1, further comprising a first armature plate that is connected to the reactor and generates a driving force by virtue of an eddy current component as a magnetic flux is generated in the first Thomson coil.

3. The switch device according to claim 1, further comprising a second armature plate that is connected to the reactor and generates a driving force by virtue of an eddy current as a magnetic flux is generated in the second Thomson coil.

4. The switch device according to claim 1, wherein the switch is configured to cut off the electric current for braking the reactor as the open operation or the close operation is completed.

* * * * *